US008867974B2

(12) United States Patent
Sakamaki

(10) Patent No.: US 8,867,974 B2
(45) Date of Patent: Oct. 21, 2014

(54) IMAGE FORMING APPARATUS

(75) Inventor: Hideyuki Sakamaki, Chiba (JP)

(73) Assignee: Seiko I Infotech Inc. (JP)

( * ) Notice: Subject to any disclaimer, the term of this patent is extended or adjusted under 35 U.S.C. 154(b) by 0 days.

(21) Appl. No.: 13/878,674

(22) PCT Filed: Sep. 14, 2011

(86) PCT No.: PCT/JP2011/071021

§ 371 (c)(1),
(2), (4) Date: Jul. 2, 2013

(87) PCT Pub. No.: WO2012/063552

PCT Pub. Date: May 18, 2012

(65) Prior Publication Data

US 2013/0279954 A1 Oct. 24, 2013

(30) Foreign Application Priority Data

Nov. 8, 2010 (JP) ..... 2010-249978
Sep. 9, 2011 (JP) ..... 2011-197358

(51) Int. Cl.

| | |
|---|---|
| ***G03G 15/14*** | (2006.01) |
| ***G03G 15/20*** | (2006.01) |
| ***G03G 15/16*** | (2006.01) |
| ***G03G 15/00*** | (2006.01) |

(52) U.S. Cl.

CPC ..... *G03G 15/2085* (2013.01); *G03G 15/2075* (2013.01); *G03G 15/165* (2013.01); *G03G 15/657* (2013.01)

USPC ..... 399/323

(58) Field of Classification Search

CPC ..... G03G 15/20
USPC ..... 399/323
See application file for complete search history.

(56) References Cited

U.S. PATENT DOCUMENTS 3,941,472 A * 3/1976 Nagahara et al. ..... 399/161
5,019,871 A * 5/1991 Takeda et al. ..... 399/66

(Continued)

FOREIGN PATENT DOCUMENTS

JP H0943995 * 2/1997 ..... G03G 15/14
JP H11338263 * 12/1999 ..... G03G 15/14
JP 2002139918 * 5/2002 ..... G03G 15/14

OTHER PUBLICATIONS

Seiko I Infotech Inc., PCT/JP2011/071021, Oct. 18, 2011, Written Opinion of the ISA, pp. 1-4.*

(Continued)

*Primary Examiner* — Clayton E Laballe
*Assistant Examiner* — Kevin Butler
(74) *Attorney, Agent, or Firm* — Adams & Wilks

(57) ABSTRACT

Provided is an image forming apparatus which uses a separation claw to separate a recording medium from a photosensitive member without damaging the recording medium even when the recording medium is thin. The employed separation claw fixed to a frame is a flattened plate made of a resin. The separation claw is gradually tapered toward a leading end thereof, and is provided with a slit from the apex toward the frame . The separation claw is not gradually tapered in a thickness direction and has a constant thickness. A plurality of separation claws are fixed to the frame in a length direction of the photosensitive drum so that the recording medium can be separated regardless of the sheet size. The frame is moved to easily adjust the positional relationship between the photosensitive drum and the separation claws.

4 Claims, 6 Drawing Sheets

(56) References Cited

U.S. PATENT DOCUMENTS

| | | | | |
|---|---|---|---|---|
| 5,161,796 | A * | 11/1992 | Okamoto | 271/308 |
| 5,978,644 | A * | 11/1999 | Sato et al. | 399/397 |
| 7,684,744 | B2 * | 3/2010 | Uchida | 399/323 |
| 8,380,118 | B2 * | 2/2013 | Barton | 399/398 |
| 2008/0145117 | A1 * | 6/2008 | Takiguchi et al. | 399/350 |
| 2009/0180819 | A1 * | 7/2009 | Rasch et al. | 399/323 |
| 2012/0251204 | A1 * | 10/2012 | Takahashi | 399/323 |
| 2013/0051835 | A1 * | 2/2013 | Kubo | 399/92 |
| 2013/0279954 | A1 * | 10/2013 | Sakamaki | 399/323 |

OTHER PUBLICATIONS

International Search Report in PCT/JP2011/071021, mailed Oct. 18, 2011, 2 pages.

* cited by examiner

IMAGE FORMING APPARATUS

TECHNICAL FIELD

The present invention relates to an image forming apparatus, and more particularly, to an image forming apparatus including a separation claw for separating a recording medium from a photosensitive drum.

BACKGROUND ART

Electrophotographic image forming apparatus are widely known. Those image forming apparatus are apparatus which are configured to form an electrostatic latent image on a surface of a photosensitive drum with light, cause toner to adhere on the photosensitive drum along the electrostatic latent image, transfer the adhered toner onto a recording medium such as paper, and fix the toner onto the recording medium by a fixing device.

In order to cause the toner to adhere from the photosensitive drum to the recording medium, it is necessary to cause the recording medium to adhere onto the rotating photosensitive drum to transfer the toner. After that, the recording medium is separated from the photosensitive drum, but the recording medium does not separate from the photosensitive drum in some cases. To address such a case, there is known an image forming apparatus including a separation claw for forcibly separating the recording medium from the photosensitive drum.

For example, as disclosed in Japanese Patent Application Laid-open No. Hei 9-43995, there is known an image forming apparatus having a configuration in which the separation claw includes a separation claw main body and a holding member, the separation claw main body is swingably mounted to a housing of a cleaning device through intermediation of the holding member, and a claw part moves along a surface of the photosensitive drum due to the own weight of a weight part of the separation claw main body. The separation claw is made of a resin, and has a weight structure whose leading end is sharp. In the structure, the leading end is formed sharp, and the leading end is pushed into a region between the photosensitive drum and recording paper to separate the recording paper. Further, the separation claw main body is integrally molded from a resin material so as to include the tapered claw part at a front end and the weight part at a rear end thereof. Further, the holding member is formed of an elastically deformable thin plate made of a metal. Therefore, for example, even when a force acts to the claw part at the time of removing paper clogging near the photosensitive drum, the holding member elastically deforms in accordance with this force, and hence the paper removal can be facilitated. In addition, the claw part is prevented from being damaged and the like. An image forming apparatus including such a separation claw is known.

CITATION LIST

Patent Literature

[PTL 1] JP 9-43995 A

SUMMARY OF INVENTION

Technical Problem

In the conventional technology, the separation claw part abuts against the photosensitive drum due to the own weight of the weight part about an axis. Further, the friction between the claw and the pivoting part of the holding portion differs depending on each separation claw. Thus, it is difficult to adjust the plurality of separation claws to obtain a uniform abutment pressure. It is necessary to adjust the abutment degree against the photosensitive drum for each of the separation claws. Therefore, it takes a large amount of time for manufacture and maintenance. Further, in some cases, the separation claw may be easily separated from the photosensitive drum due to an external cause such as vibration of devices. When the leading edge of the recording paper passes under a state in which the separation claw is separated from the photosensitive drum, paper jam occurs. Further, the structure of the separation claw is complicated, and the number of steps for manufacture and assembly is large, which leads to low workability. Further, the separation claw is formed to have a sharp leading end and is biased by the weight. Therefore, in a case of thin recording paper which firmly adheres to the photosensitive drum, due to the impact of collision between the separation claw and the recording paper, the separation claw may float upward, which may prevent the separation claw from entering below the recording paper to cause a jam.

Solution to Problem

The present invention has been made to solve such problems, and provides an image forming apparatus which is capable of, with a simple structure, easily adjusting a plurality of separation claws to have a constant abutment pressure, and reliably separating a recording medium from a photosensitive drum even when a thin recording medium is used.

According to the present invention, there is provided an image forming apparatus, including: a photosensitive drum onto which toner adheres in accordance with an electrostatic latent image formed on a surface thereof; a transfer device for transferring the toner adhering on the photosensitive drum onto a recording medium; a fixing device for fixing the toner onto the recording medium; a separation claw for separating the recording medium adhering onto the photosensitive drum; a separation claw fixing frame for fixing the separation claw; a separation claw fixing plate made of a metal, which is fixed between the separation claw and the separation claw fixing frame; a conveyance guide plate arranged opposed to the separation claw fixing frame, the conveyance guide plate being configured to guide the recording medium; and a spur provided on the separation claw fixing frame and fixed on a downstream side with respect to the separation claw in a conveyance direction of the recording medium, the spur being configured to guide the recording medium so as to be conveyed on the conveyance guide plate side and on the fixing device side, in which the separation claw fixing frame includes deformation prevention means for preventing deformation of a part fixed to the separation claw fixing plate, in which the spur has a rotational shaft arranged at such a position that a distance between the rotational shaft and the conveyance guide plate is larger than a distance between the separation claw and the conveyance guide plate, and a distance between a leading end of the spur and the conveyance guide plate is smaller than the distance between the separation claw and the conveyance guide plate, in which the separation claw includes a plate made of a resin, the plate being formed to be gradually tapered toward a leading end of a leading end part of the separation claw without changing a thickness, and in which a fixing position of the separation claw fixing frame is changed to change a position of the separation claw and a position of the spur with respect to one of the photosensitive drum and the conveyance guide plate, to thereby cause the separation claw to abut against the photosensitive drum by a predetermined length from the leading end so as to include a part of the leading end part.

Advantageous Effects of Invention

According to the present invention, it is possible to, with a simple structure, easily adjust the plurality of separation claws to have a constant abutment pressure, and reliably separate the recording medium from the photosensitive drum even when a thin recording medium is used.

FIG. [2] A layout view of separation claws.

FIG. [3] A view illustrating a configuration of the separation claw.

FIG. [4] Views illustrating collision between a recording medium and the separation claw abutting against a photosensitive drum.

FIG. [5] Second views illustrating collision between the recording medium and the separation claw abutting against the photosensitive drum.

FIG. [6] A view illustrating configurations of the separation claw and a spur.

DESCRIPTION OF EMBODIMENTS

Description is made of embodiments of the present invention with reference to the drawings.

Figure 1:
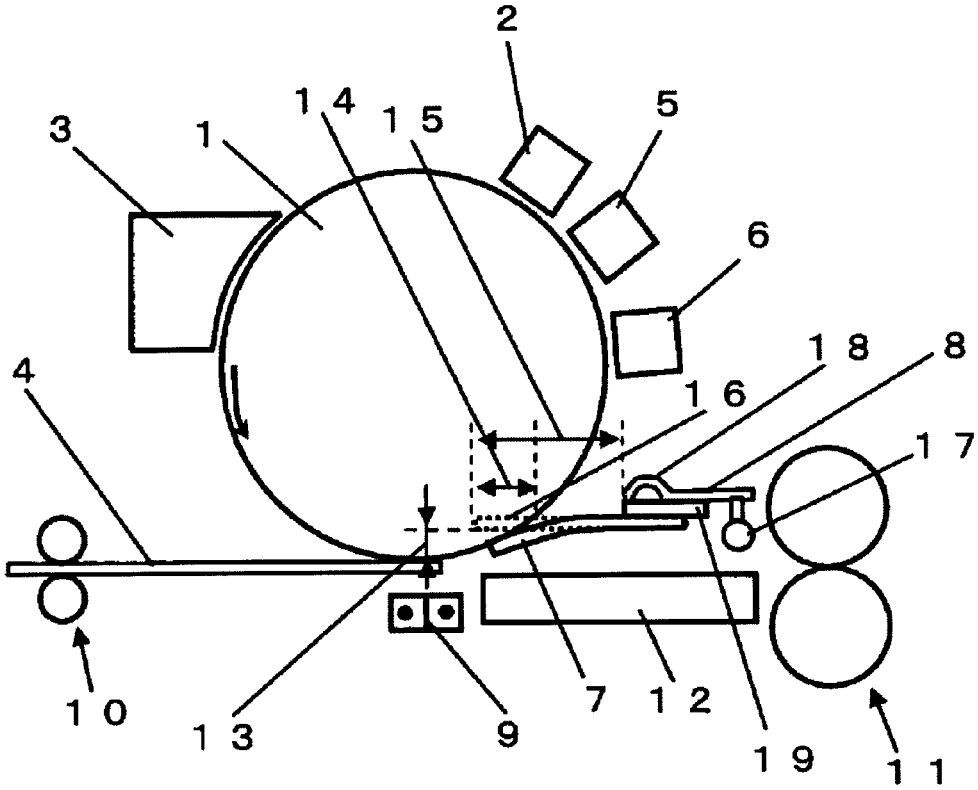
[FIG. 1] A schematic configuration view of an image forming apparatus.

FIG. 1 is a schematic configuration view of an image forming apparatus. A photosensitive drum 1 is a columnar rotatable member. Toner is caused to adhere on the surface thereof, and the toner is transferred onto a conveyed recording medium 4. The toner is fixed on the surface of the recording medium 4 with heat and pressure at a fixing device 11. An electrostatic latent image is formed on the surface of the photosensitive drum 1 by an LED head 2, and the toner is caused to adhere correspondingly to the electrostatic latent image by a developing device 3. The toner adhering on the surface of the photosensitive drum 1 is caused to adhere onto the recording medium 4 by a transfer device 9. The recording medium 4 corresponds to paper, a plastic film, or the like. The recording medium 4 is conveyed to the fixing device 11 along a conveyance guide plate 12 by a conveyance roller 10. The conveyance roller 10 includes a rotatable roller and a roller which is pressed by the rotatable roller to rotate in association with the rotatable roller. With the rotation of the rollers, the recording medium 4 is conveyed. The fixing device 11 includes a heating roller equipped with a heat generating member and a pressure roller for biasing the heating roller. The toner is fixed onto the recording medium with heat and pressure. The toner is transferred onto the recording medium 4 by the transfer device 9, but trace toner remains. The toner remaining on the photosensitive drum 1 is removed by a cleaning unit 6, and further the charging is eliminated. After that, the surface of the photosensitive drum 1 is charged again by a charging device 5, to thereby form an electrostatic latent image of a desired image by the LED head 2.

A separation claw 7 is fixed to a separation claw fixing frame 8. The separation claw 7 is provided to separate the recording medium 4 in a case where the recording medium 4 that has passed through the transfer device 9 is not separated from the photosensitive drum 1 and is conveyed while still adhering onto the photosensitive drum 1. A leading end part of the separation claw 7 abuts against the photosensitive drum 1. When the recording medium 4 is conveyed while still adhering onto the photosensitive drum 1, the separation claw 7 separates the recording medium 4 from the photosensitive drum 1, and the recording medium 4 is guided to the fixing device 11. The leading end of the separation claw fixing frame 8 includes a recessed part 18. A separation claw fixing plate 19 is fixed to the separation claw fixing frame 8, and the separation claw 7 is fixed to the separation claw fixing plate 19. The separation claw fixing plate 19 and the separation claw 7 are fixed by an adhesive, pressure-sensitive adhesive tape, or the like. Further, a spur 17 is provided to the separation claw fixing frame 8 so that the recording medium 4 does not hit the separation claw 7 and the separation claw fixing frame 8.

A specific example of the positional relationship between the separation claw 7 and the photosensitive drum 1 is described. The photosensitive drum 1 has a diameter of 60 mm. A difference 13 in a perpendicular direction between a lower end of the outer circumference of the photosensitive drum 1 and the location of the separation claw 7 is 2.9 mm. Further, the separation claw 7 is arranged in a manner that the leading end thereof is curved so as to be brought into contact with the photosensitive drum 1. A position 16 of the separation claw indicated by the dotted lines represents a position in a case where the photosensitive drum 1 is absent. An overlapping length 14 of the separation claw 7 with respect to the photosensitive drum 1 is 1.6 mm. A distance 15 from the leading end to the fixed end of the separation claw 7 is 8.0 mm.

The separation claw 7 is arranged in parallel to a tangential direction of the lower end of the outer circumference of the photosensitive drum 1. With this, the height from the lower end and the contact angle can be easily adjusted.

When the separation claw fixing frame 8 is close to the photosensitive drum 1, the separation claw 7 is significantly curved, and the leading end may separate from the photosensitive drum 1, which is not preferred. When the difference 13 in the perpendicular direction between the lower end of the outer circumference of the photosensitive drum 1 and the location of the separation claw 7 is large, the separation claw 7 is significantly curved, and the leading end may separate from the photosensitive drum 1, which is not preferred. It is preferred that a part of a slit 23 to be described later, which is provided at the leading end of the separation claw 7, abut against the photosensitive drum 1. Further, it is preferred that the separation claw 7 abut against the photosensitive drum 1 at a position in an accuracy range of 15 to 30 degrees with respect to the vertical direction from the center of the photosensitive drum 1. It is necessary to maintain a height that enables passage of the recording medium 4. Further, in order to reliably obtain the effect of the slit 23, it is necessary to bring the separation claw 7 into contact with the photosensitive drum 1 by half or more of the length of the slit 23, for example, 1 mm or more, from the leading end of the separation claw 7.

The recessed part 18 is provided to increase the rigidity of the leading end of the separation claw fixing frame 8. The rigidity is increased to prevent deformation in a case where a jam occurs. Deformation of the leading end of the separation claw fixing frame 8 is not preferred because the leading end of the separation claw fixing frame 8 relates to positioning of the separation claw 7. Further, the recessed part 18 has a leading end with a narrow width, and hence when the separation claw 7 made of a resin directly hits the leading end of the recessed part 18, the separation claw 7 may break in some cases.

Therefore, in order to prevent direct contact, the separation claw fixing plate 19 is provided. The separation claw fixing plate 19 is formed of a metal plate which has rigidity, such as AL and SUS.

Figure 2:
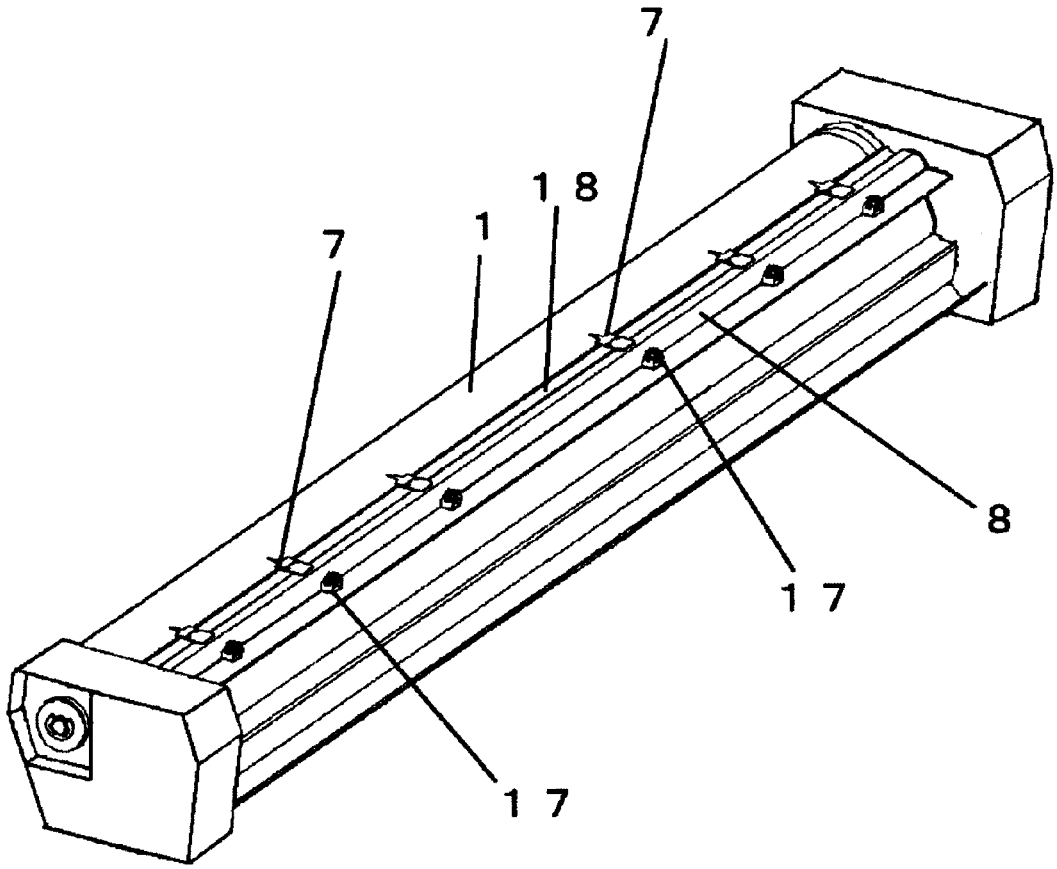

FIG. 2 is a layout view of the separation claws. Six separation claws 7 are arranged in the length direction of the photosensitive drum 1 at regular intervals from the center toward the ends. The spurs 17 are arranged at positions corresponding to the separation claws 7. The separation claws 7 are arranged so that, even when the width of the used storage medium 4 is changed, separation is possible at a plurality of positions of at least two positions. Therefore, it is desired that the way of contact between each separation claw 7 and the photosensitive drum 1 be uniform. The separation claws 7 can be uniformly mounted to the separation claw fixing frame 8, and the separation claws 7 having the same shape can be mass-produced. Therefore, the way of contact between each separation claw 7 and the photosensitive drum 1 can be easily set uniform. Further, all of the separation claws 7 are fixed to the separation claw fixing frame 8, and hence all of the separation claws 7 can be moved by moving the separation claw fixing plate 8. Thus, a separating/approaching position of the separation claw 7 and the photosensitive drum 1 can be easily adjusted. Further, the photosensitive drum 1 and the separation claw fixing frame 8 each have both ends fixed by a side fixing member. The separation claw fixing frame 8 is fixed to the side fixing member in a manner that its angle and position can be changed. This photosensitive drum 1, separation claw fixing frame 8, and side fixing member can be handled as a single unit, and the unit is removably mounted to the image forming apparatus.

Figure 3:
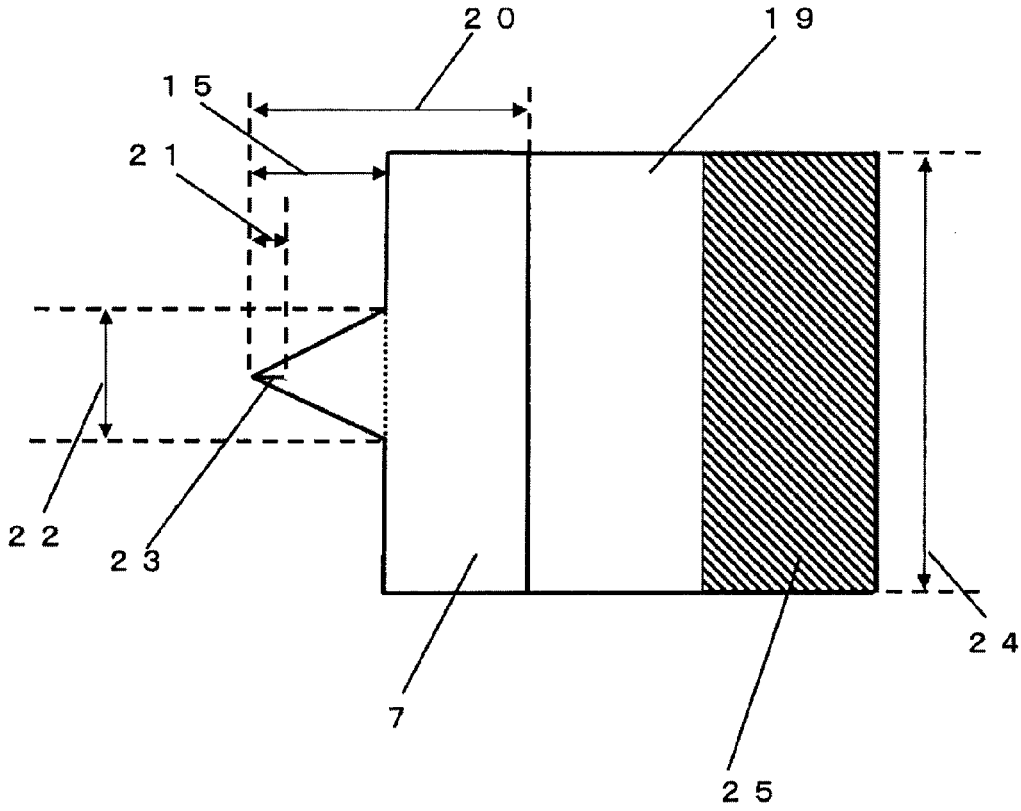

FIG. 3 is a view illustrating the configuration of the separation claw. The separation claw 7 is a flattened thin plate made of a resin. For example, engineering plastic such as PET and POM resins is particularly preferred in terms of durability and the like. Resins such as PP may be used as well. The thickness is 0.25 mm. The separation claw 7 to be used is preferred to have a thickness larger than that of the recording medium 4, preferably 0.15 mm or more and 0.35 mm or less. The thickness may not be too large or small. it is preferred that a plate having a suitable thickness be used in accordance with the thickness of the recording medium 4 to be used or the positional relationship with respect to the photosensitive drum 1.

The separation claw 7 is fixed to the separation claw fixing plate 19 except for a leading end part of the separation claw. The separation claw 7 is fixed by adhesion, by welding, with use of two-sided pressure-sensitive adhesive tape, or the like. The separation claw fixing plate 19 is fixed to the separation claw fixing frame 8 at a separation claw fixing part 25 represented by a shaded area. The separation claw fixing plate 19 is fixed by adhesion, with use of two-sided pressure-sensitive adhesive tape, or the like.

The leading end part of the separation claw 7 is gradually tapered toward the apex. The separation claw 7 is not gradually tapered in the thickness direction, and maintains a constant thickness. Thus, deformation in the thickness direction is prevented. The slit 23 is provided from the apex of the leading end of the separation claw 7 toward the root. A length 15 of the leading end part of the separation claw 7 is 8.0 mm. A width 22 of the root of the leading end part is 6.0 mm. A length 21 of the slit 23 is 2.0 mm. A width 24 of the separation claw 7 in a part fixed to the separation claw fixing plate 19 is 16.0 mm. The entire length 20 of the separation claw 7 is 14.0 mm. It is preferred to select those dimensions in accordance with the thickness of the recording medium 4 to be used and the positional relationship with respect to the photosensitive drum 1 as well.

Figure 4:
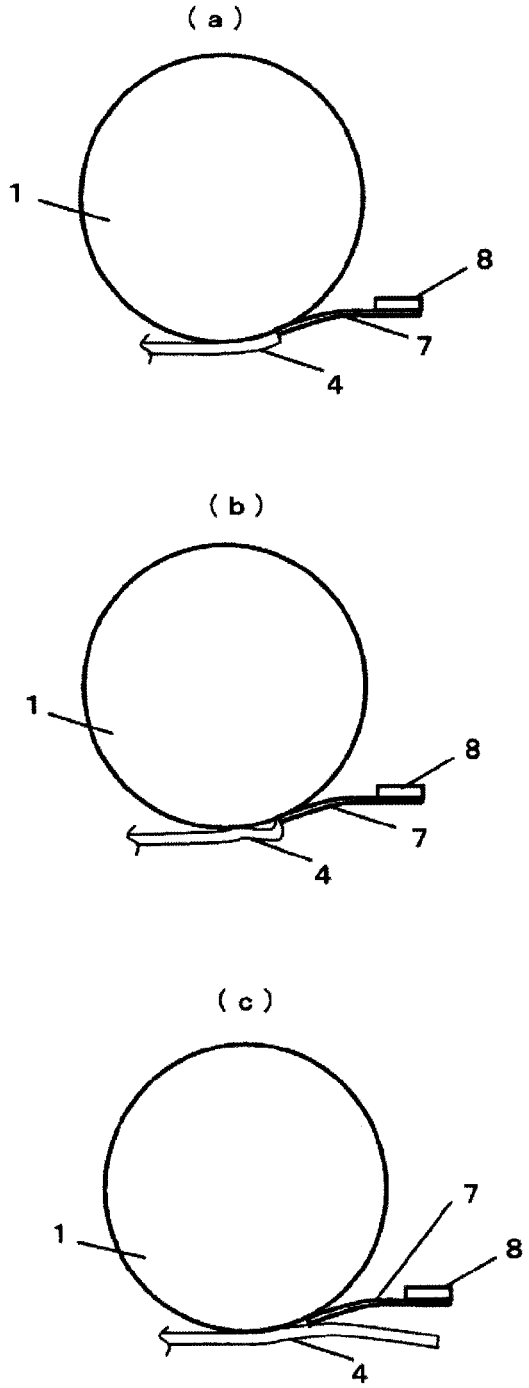

FIGS. 4 are views illustrating collision between the recording medium and the separation claw abutting against the photosensitive drum. FIG. 4 (*a*) is a view illustrating a state immediately before the collision. FIG. 4 (*b*) is a view illustrating a state at the time of the collision. FIG. 4 (*c*) is a view illustrating a state in which the separation claw separates the recording medium. Note that, the separation claw fixing plate 19 is omitted in the figures.

When the photosensitive drum 1 is rotated while the recording medium 4 is still adhering onto the photosensitive drum 1, the leading edge of the recording medium 4 collides with the leading end of the separation claw 7. The leading end of the separation claw 7 is provided with the slit 23, and hence at the time of the collision, the slit 23 deforms so as to extend its width. With this deformation, energy of the collision is absorbed. The energy of the collision is reduced, and hence the separation claw 7 is prevented from floating upward.

After the collision between the recording medium 4 and the separation claw 7, the recording medium 4 is warped, and its leading edge floats upward.

Because the leading edge of the recording medium 4 floats upward, the separation claw 7 enters a space between the photosensitive drum 1 and the recording medium 4. After that, the recording medium 4 is separated from the photosensitive drum 1 by the separation claw 7.

The separation claw 7 abuts against the photosensitive drum 1, and is warped so as to protrude on a side opposite to the direction of the passage of the recording medium 1. Therefore, the separated recording medium 4 is prevented from hitting the separation claw 7 to scrape off the transferred toner.

Figure 5:
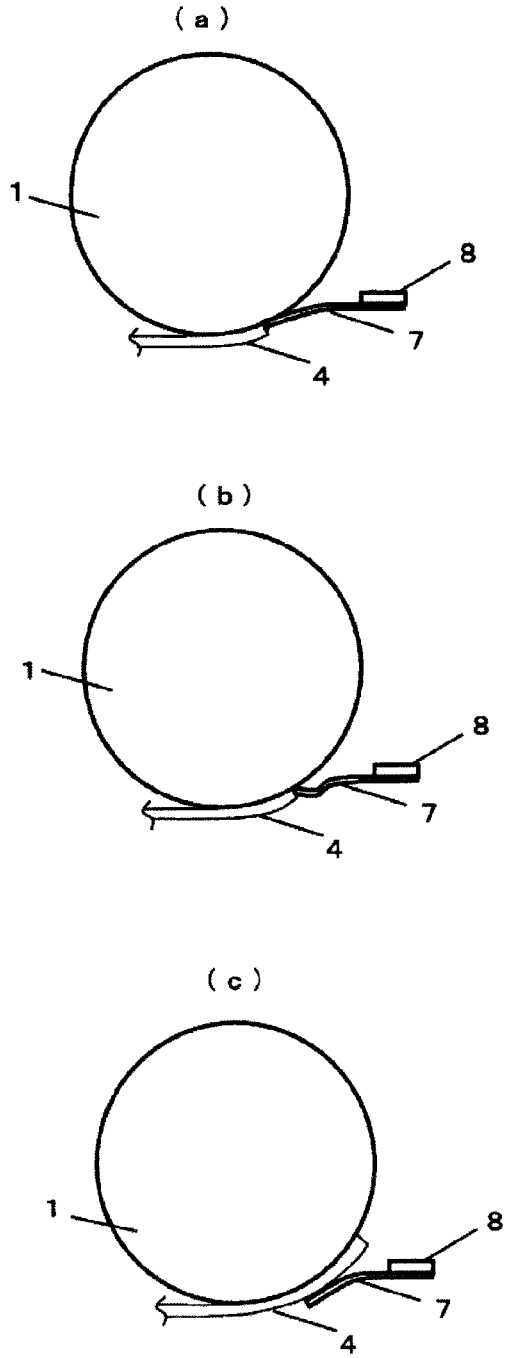

FIGS. 5 are second views illustrating collision between the recording medium and the separation claw abutting against the photosensitive drum. FIG. 5 (*a*) is a view illustrating a state immediately before the collision. FIG. 5 (*b*) is a view illustrating a state at the time of the collision. FIG. 5 (*c*) is a view illustrating a state in which the recording medium passes without being separated. The figures illustrate an example in which, when the separation claw 7 is too thin and the recording medium 4 is thick, the separation claw 7 deforms at the time of the collision between the recording medium 4 and the separation claw 7, and hence the recording medium 4 cannot be separated. Note that, the separation claw fixing plate 19 is omitted in the figures.

When the photosensitive drum 1 is rotated while the recording medium 4 is still adhering onto the photosensitive drum 1, the leading edge of the recording medium 4 collides with the leading end of the separation claw 7. When the separation claw 7 is too thin, the recording medium 4 does not deform but the separation claw 7 deforms. The leading end of the separation claw 7 is provided with the slit 23, and hence at the time of the collision, the slit 23 deforms so as to extend its width. Even when the energy of the collision is reduced by this deformation through absorption of the energy of the collision, the separation claw 7 is deformed. When the recording medium 4 does not deform but the separation claw 7 deforms, the recording medium 4 passes between the photosensitive drum 1 and the separation claw 7 while still adhering onto the photosensitive drum 1, which causes a jam.

Through setting of the positional relationship between the separation claw 7 and the photosensitive drum 1, it is possible to produce a state in which the leading end of the separation claw 7 abuts against the photosensitive drum 1, the separation claw 7 is warped, and the leading end of the separation claw 7 is biased in the direction of the photosensitive drum 1. At this time, in order to prevent the separation claw 7 from separating from the photosensitive drum 1 due to the collision with respect to the recording medium 4, a slit is preferred to be provided at the leading end of the separation claw 7. When the separation claw 7 is too thin, the separation claw 7 deforms due to the collision with respect to the recording medium 4, which may inhibit separation. Thus, the separation claw 7 needs an appropriate thickness.

Further, as another embodiment of the present invention, a slit may be omitted at the leading end of the separation claw 7. In this case, it is desired that the separation claw 7 be as thin as possible. When the slit is provided, the leading end may easily deform in the width direction, but when the slit is omitted, the thickness may be reduced to facilitate the deformation of the leading end of the separation claw 7.

Figure 6:
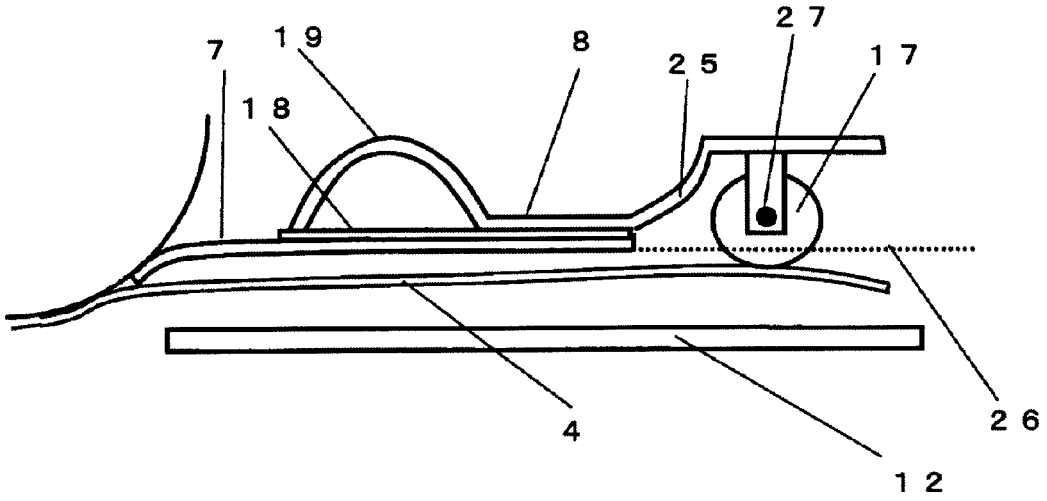

FIG. 6 is a view illustrating the configurations of the separation claw and the spur. FIG. 6 is a schematic view clearly illustrating how the separation claw 7 and the spur 17 illustrated in FIG. 2 are arranged on the separation claw fixing frame 8. The separation claw 7 is fixed to the separation claw fixing frame 8 through the intermediation of the separation claw fixing plate 19. The separation claw fixing plate 19 is fixed across the recessed part 18 provided at the leading end part of the separation claw fixing frame 8. Further, the spur 17 is fixed to the separation claw fixing frame 8 on a side opposed to the recessed part 18. When the spur 17 is arranged on the same plane 26 as the separation claw fixing plate 19, the leading end of the spur 17 and the position of the separation claw 7 become too far away from each other, and hence the leading edge of the separated recording medium 4 may travel toward the root side of the spur. In such a case, the spur 17 may rotate backward, and the recording medium 4 may not be normally conveyed, which may cause a jam. In order to avoid such a problem, a bent part 25 is provided to the separation claw fixing frame 8, and the spur 17 is fixed to the bent part 25. It is preferred that a rotational shaft 27 of the spur 17 be arranged above the plane 26 on which the separation claw 7 is arranged. With this, the spur 7 rotates forward when abutting against the recording medium 4, and a jam can be prevented. That is, the rotational shaft 27 of the spur 17 is arranged at such a position that a distance between the rotational shaft 27 and the conveyance guide plate 12 is larger than a distance between the separation claw 7 and the conveyance guide plate 12, and a distance between the leading end of the spur 17 and the conveyance guide plate 12 is smaller than the distance between the separation claw 7 and the conveyance guide plate 12.

The separation claw 7 and the spur 17 are fixed on the same separation claw fixing frame 8, and hence by changing the fixing position of the separation claw fixing frame 8, all of the separation claws 7 and spurs 17 are simultaneously positioned with respect to the photosensitive drum 1 and the conveyance guide plate 12. Further, all of the separation claws 7 and spurs 17 can be arranged at the same accuracy with respect to the photosensitive drum 1 and the conveyance guide plate 12. With this, the steps for work of mounting and positioning may remarkably be facilitated.

INDUSTRIAL APPLICABILITY

The present invention is applicable to an electrophotographic image forming apparatus.

REFERENCE SIGNS LIST

1 photosensitive drum
2 LED head
3 developing device
4 recording medium
5 charging device
6 cleaning unit
7 separation claw
8 separation claw fixing frame
9 transfer device
10 conveyance roller
11 fixing device

The invention claimed is:

1. An image forming apparatus, comprising:

a photosensitive drum onto which toner adheres in accordance with an electrostatic latent image formed on a surface thereof;

a transfer device for transferring the toner adhering on the photosensitive drum onto a recording medium;

a fixing device for fixing the toner onto the recording medium;

a separation claw for separating the recording medium adhering onto the photosensitive drum;

a separation claw fixing frame for fixing the separation claw;

a separation claw fixing plate made of a metal, which is fixed between the separation claw and the separation claw fixing frame;

a conveyance guide plate arranged opposed to the separation claw fixing frame, the conveyance guide plate being configured to guide the recording medium; and a spur provided on the separation claw fixing frame and fixed on a downstream side with respect to the separation claw in a conveyance direction of the recording medium, the spur being configured to guide the recording medium so as to be conveyed on the conveyance guide plate side and on the fixing device side, wherein the separation claw fixing frame comprises deformation prevention means for preventing deformation of a part fixed to the separation claw fixing plate, wherein the spur has a rotational shaft arranged at such a position that a distance between the rotational shaft and the conveyance guide plate is larger than a distance between the separation claw and the conveyance guide plate, and a distance between a leading end of the spur and the conveyance guide plate is smaller than the distance between the separation claw and the conveyance guide plate, wherein the separation claw comprises a plate made of a resin, the plate being formed to be gradually tapered toward a leading end of a leading end part of the separation claw without changing a thickness, and wherein a fixing position of the separation claw fixing frame is changed to change a position of the separation claw and a position of the spur with respect to one of the photosensitive drum and the conveyance guide plate, to thereby cause the separation claw to abut against the photosensitive drum by a predetermined length from the leading end so as to include a part of the leading end part.

2. An image forming apparatus according to claim 1, wherein the deformation prevention means is obtained by forming an end part of the separation claw fixing frame on the photosensitive drum side into a recessed shape along a longitudinal direction of the separation claw fixing frame, the separation claw fixing plate being fixed to the separation claw fixing frame across the end part formed into the recessed shape.

3. An image forming apparatus according to claim 2, wherein the separation claw fixing frame comprises a bent part provided so that a part of a surface of the separation claw fixing frame, which is opposed to the conveyance guide plate and on which the spur is fixed, is directed away from the conveyance guide plate.

4. An image forming apparatus according to claim 3, wherein the separation claw comprises a slit extending from the leading end toward the separation claw fixing plate.

* * * * *